US006607152B2

(12) United States Patent
Yanase

(10) Patent No.: US 6,607,152 B2
(45) Date of Patent: Aug. 19, 2003

(54) MILL

(76) Inventor: Sigeo Yanase, 27-19 Gion 3-chome, Kisarazu City Chiba (JP)

( * ) Notice: Subject to any disclaimer, the term of this patent is extended or adjusted under 35 U.S.C. 154(b) by 35 days.

(21) Appl. No.: 10/008,580

(22) Filed: Nov. 6, 2001

(65) Prior Publication Data

US 2003/0006329 A1 Jan. 9, 2003

(30) Foreign Application Priority Data

Jul. 6, 2001 (JP) ..... 2001-205780

(51) Int. Cl.[7] ..... B02C 17/16
(52) U.S. Cl. ..... 241/172; 241/176
(58) Field of Search ..... 241/171, 172, 241/176

(56) References Cited

U.S. PATENT DOCUMENTS 3,223,336 A * 12/1965 Wienert ..... 241/172
3,993,254 A * 11/1976 Bicik et al. ..... 241/67
5,984,213 A * 11/1999 Woodall et al. ..... 241/21

FOREIGN PATENT DOCUMENTS

JP 2576930 5/1994
JP 3071823 9/2000

* cited by examiner

*Primary Examiner*—Mark Rosenbaum
(74) *Attorney, Agent, or Firm*—David R. Preston & Associates

(57) ABSTRACT

This invention relates to the mill wherein balls which are loading members in a milling chamber are made to move reciprocating motion certainly in the axis direction of a revolving shaft in addition to vertical motion so that a mass of objects can be milled in a short time, and which comprises of: a drum body providing an introduction inlet on one end thereof and the exhaust outlet on the other end thereof; a revolving shaft running through the inside of the dram body in the axis direction of the body; division members mounted on the revolving shaft with tilted angle to the vertical of said shaft dividing the inside of dram body, and forming plural milling chambers communicating through mutually in said dram body and pleural loading members for milling charged in said milling chamber, wherein said loading members repeat raising and falling by rotating said division members and move with reciprocating motion in the axis direction of the shaft.

9 Claims, 5 Drawing Sheets

MILL

This application claims benefit of priority to Japanese patent application Serial No. 2001-205780 filed on Jul. 6, 2001 to Sigeo Yanase.

FIELD OF THE INVENTION

This present invention relates to the mill wherein balls which are loading members in a milling chamber are made to move reciprocating motion certainly in the axis direction of a revolving shaft in addition to vertical motion so that a mass of objects to be milled can be milled in a short time.

PRIOR ART

Various ball-mill type mills as devices to obtain recycled aggregate with peeling off concrete from used aggregate adhered concrete and/or asphalt or to make the grain diameter of the aggregate small are proposed as usual. In those devices, there is one having the inside of the dram body divided with a plurality of division plates, wherein objects to be milled can be stay for long time. These division plates are mounted on a revolving shaft run through the dram body in the axis direction thereof, space where objects to be milled can pass through is provided between a periphery portion of the division plate and the inside wall of the dram body. By this means, the objects to be milled are milled by the balls while they moves from one end to the other end in the dram body.

These division plates are discs and are mounted right-angled to the revolving shaft. Thus, the division plates do not make ball move positively in the axis direction of the dram body, and the most the direction of the ball movement is the radial direction and the circumferential direction of the dram body. Therefore, since the balls does not move repetition movement enough in the dram and the balls and the objects to be milled rotate around at the equal speed, that is to say: together run phenomenon occurs at many places in the dram frequently, it is impossible that a mass of objects to be milled could be milled in short time.

This present invention was accomplished in view of such circumstance, and its object is to provide the mill wherein balls that are loading members in a milling chamber are made to move reciprocating motion certainly in the axis direction of a revolving shaft in addition to vertical motion so that a mass of objects to be milled can be milled in a short time.

BRIEF DESCRIPTION OF THE DRAWING

Embodiment of the present invention will be described with reference to the drawing.

DETAILED DESCRIPTION OF THE INVENTION

Figure 1:
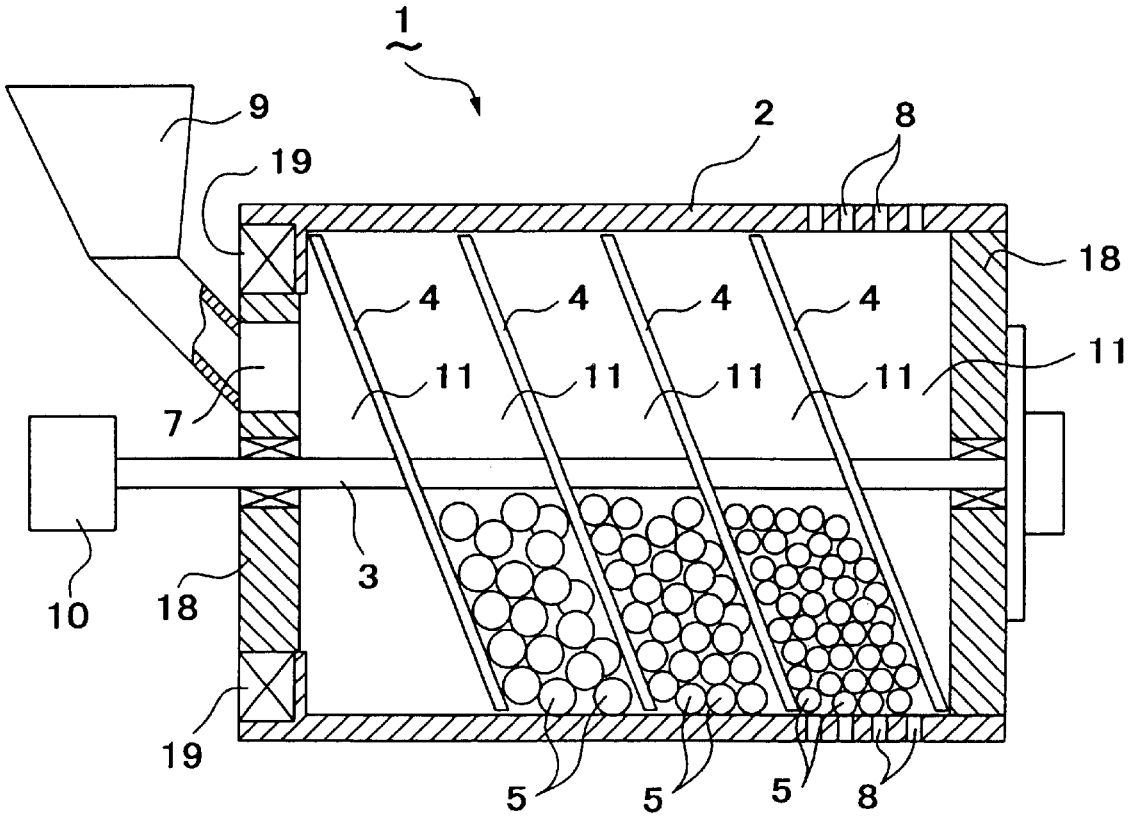
FIG. 1 is the vertical section showing the mill related to the present invention.
Figure 2:
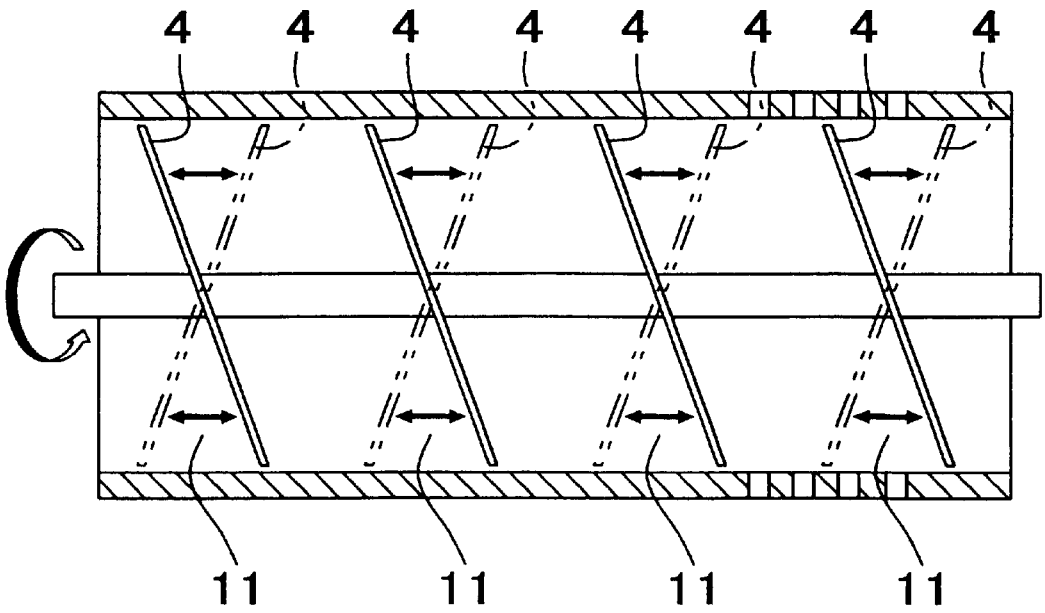
FIG. 2 is a view showing a movement in the axis direction of the revolving shaft for the division members related to the present invention.

FIG. 1 is the vertical section showing an example of the mill related to the present invention. FIG. 2 is a view showing a movement in the right and left direction (i.e. in the axis direction of the revolving shaft) for the division members related to the present invention.

The mill (1) related to the present invention comprises a dram body (2), a revolving shaft (3), division members (4) and loading members for milling (5).

The most characteristic in the present invention is that loading members for milling (5) repeat raising and falling motion and move reciprocating motion in the axis direction of the dram body (2) and revolving shaft (3) with rotating division members (4).

The introduction inlet (7) introducing objects to be milled (not shown) is provided on one end of the dram body (2) and the exhaust outlet (8) exhausting the objects to be milled after milling is provided on the other end. A hopper (9) for charging objects to be milled is connected with introduction inlet (7). The dram body (2) may be fixed so as not to rotate, or it may be rotated in the circumferential direction of the dram by the motor (not shown) for driving the dram. The exhaust outlets (8) are provided plurally on said other end of the circumferential wall portion of the dram body (2).

In an example shown in FIG. 1, end boards (18) not rotating is provided on both ends of the drum body (2), respectively, and the dram body (2) can rotate via bearing (19) provided on peripheral face of such end board (18). Introduction inlet (7) is formed on one side of the end boards (18).

Figure 8:
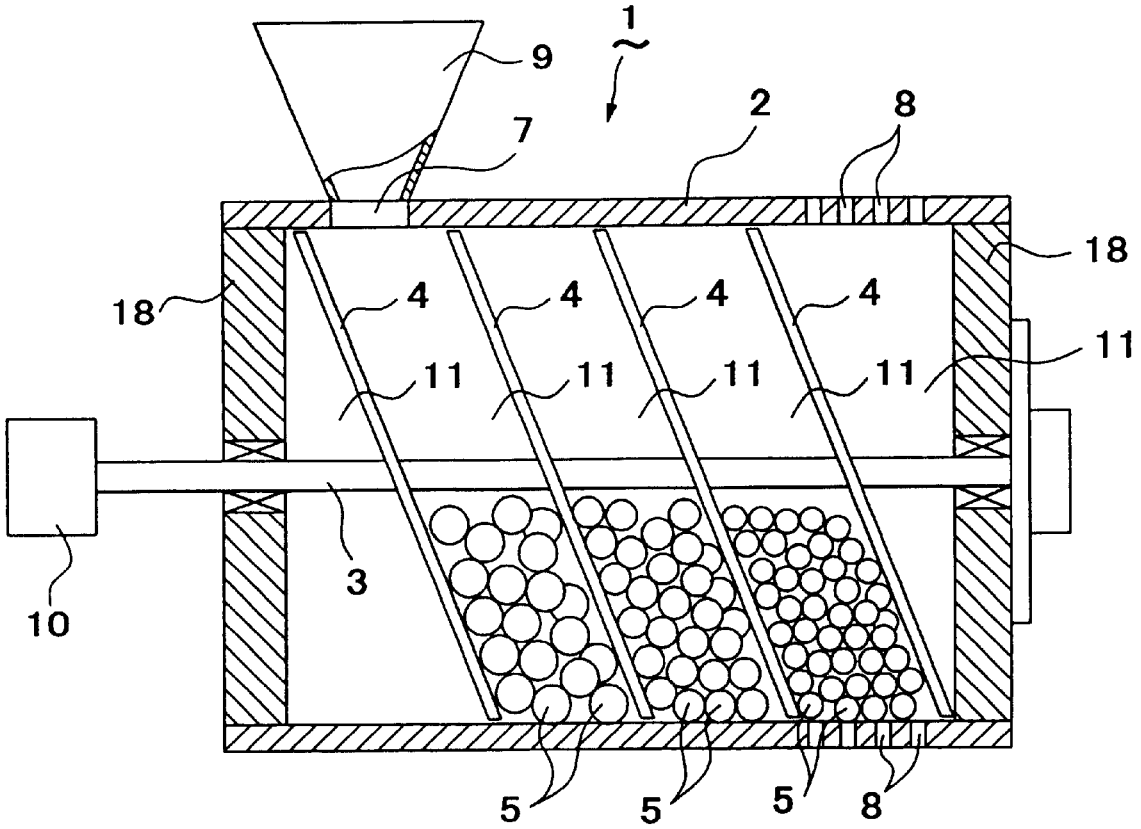
FIG. 8 is the vertical section showing another example of a mill related id to the present invention.

In the present invention, incidentally, as shown in FIG. 8, end boards (18) may be provided integrally on the both ends of dram body (2), respectively. In this case also, the dram body (2) may be fixed so as not to rotate, or it may be rotated in the circumferential direction of the dram by the motor (not shown) for driving the dram. If the drum body (2) is fixed so as not to rotate, introduction inlet (7) is provided on the upper side of the one end on the circumferential wall of the dram body (2) and a hopper for the charging (9) is connected with such introduction inlet (7).

The revolving shaft (3) is provided so as it runs through the inside of the dram body (2) in the axis direction of the dram body (2). This revolving shaft (3) may be solid or may be hollow. Such revolving shaft (3) is rotated by motor for driving (10).

The direction what revolving shaft (3) rotates and the direction what the dram body (2) rotates are mutually opposite directions.

The division members (4) are mounted on the revolving shaft (3) with tilted angle to the vertical of said revolving shaft (3). The division members (4) divide the inside of dram body (2), and form plural milling chambers (11) communicating through mutually in said dram (2). The milling chambers (11) communicate through each other, and communication through portion has the size that the loading members (5) cannot pass through.

Figure 3:
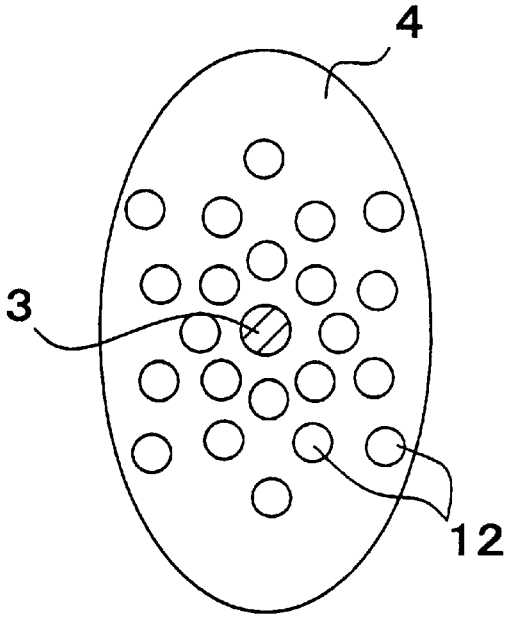
FIG. 3 is a view showing an example of a division member related to the present invention.
Figure 4:
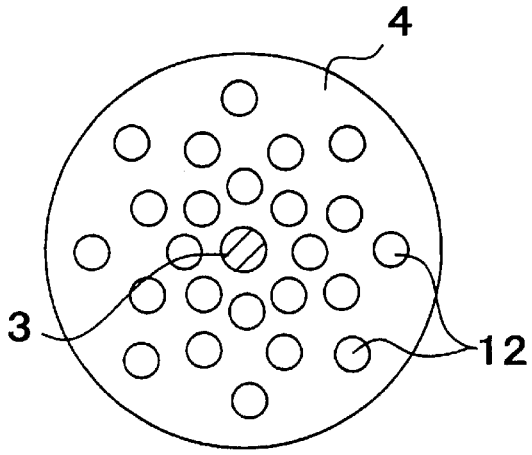
FIG. 4 is a view showing an example of a division member related to the present invention.

In the examples shown in FIGS. 3 and 4, the division member (4) has introduction holes (12) letting through objects to be milled. Such introduction holes (12) correspond to the above-mentioned communicating through portion among the milling chamber (11). The size of the introduction hole (12) is the size what only the object to be milled, which has been milled to less than fixed size, let through. As shown in FIG. 3 and FIG. 4, the division member (4) may be a board shape or may be a mesh shape.

Incidentally, in the present invention, the means for communicating through among the milling chambers (11) is not limited the introduction hole (12). If the introduction hole (12) is not provided, the clearance between the periphery portion of division member (4) and aspect of the internal circumference face of the dram body (2) should be the size what only the object to be milled, which has milled to less than fixed size, let through.

The number of division members (4) is not limited particularly, but it may be one piece or may be plural pieces. If the division member (4) is one piece, both sides across the division member (4) form milling chambers (11), respectively. As shown in FIGS. 1 and 2, when the division members (4) are provided plurally in the axis direction of revolving shaft (3) with interval mutually, each milling chamber (11) is formed between the division members (4).

When the division members (4) are provided plurally in the axis direction of revolving shaft (3) with interval mutually, the size of the introduction hole (12) formed on the division member (4) is the size what only the object to be milled, which has milled to less than fixed size, let through, and it is preferable that such fixed size becomes small gradually from the division member (4) on the upper stream side (one end side) of the dram body (2) to the division member (4) on the lower reaches side (the other end side).

The shape of the division member (4) is not particularly limited but, for example, it is able to be comprised as outline of the division member (4) en is formed elliptically and the whole periphery portion thereof approaches to the internal circumference face of the dram body (2), as shown in FIG. 3. Incidentally, it is possible to form the outline of the division member (4) circularly as shown in FIG. 4.

Figure 5:
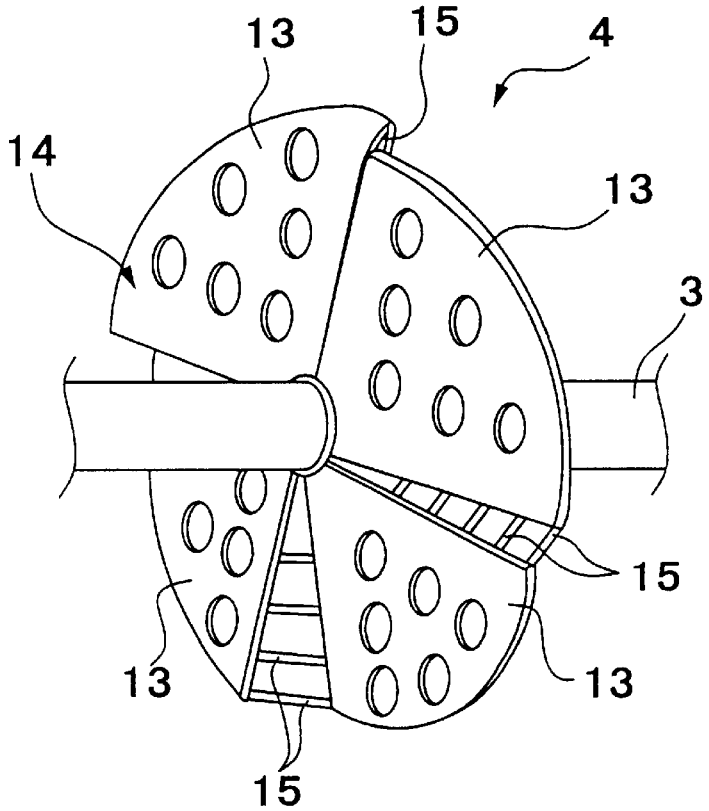
FIG. 5 is a view showing an example of a division member related to the present invention.

Moreover, as shown in FIG. 5, the division member (4) may comprises a screw-shaped portion (14), which includes plural fan-shaped portions (13) that each is arranged to tilt to revolving shaft (3) with radially and which is formed the shape of ship's screw as a whole, and the connection portion (15) connecting difference in step between adjacent fan-shaped portions (13). The connection portion (15) is for preventing passing of loading members for milling (5) and for making loading members for milling (5) to jump up certainly.

Figure 6:
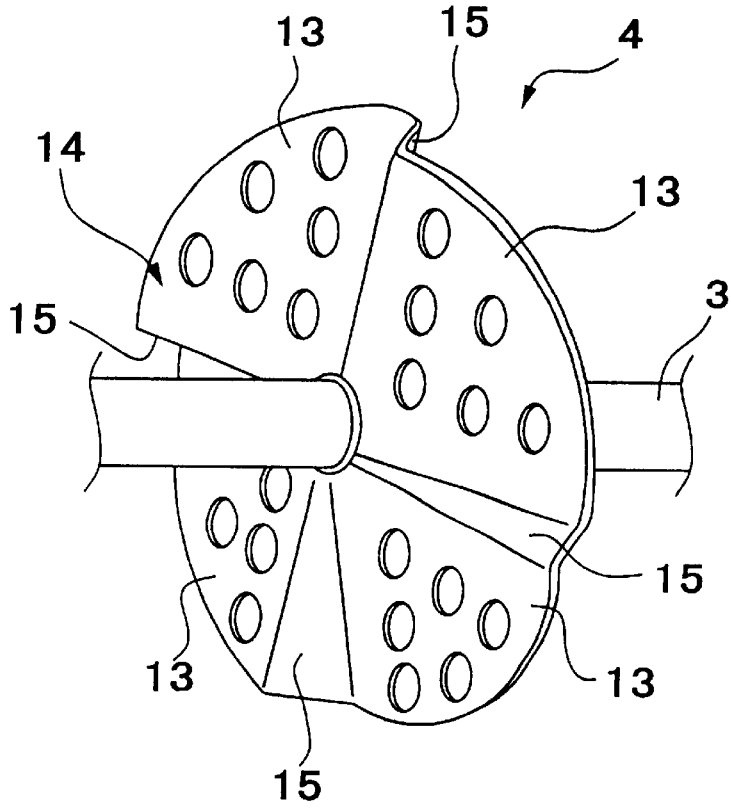
FIG. 6 is a view showing an example of a division member related to the present invention.

The connection portion (15), for example, can be comprised one or plural wire rods as shown in FIG. 5, or belt shape portion. Otherwise, the connection portions (15) and the fan-shaped portions (13) are board shape, respectively, and they can be formed integrally as shown in FIG. 6.

Pleural loading members (5) are charged in each milling chamber (11). Loading member for milling (5) is generally ball made of metal. By rotating the division member (4) mounted with tilted condition, loading members (5) (hereinafter, named as Loading members (5)) jumps within milling chamber (11) and collide with objects to be milled. At this time, milling the objects to be milled is carried out.

The present invention has a characteristic in the movement of such loading members (5). In the other words, since the division member (4) is mounted with tilted angle to the vertical of said revolving shaft (3), it shows a state of slanting to right (see solid line in Fig) at one moment and it shows a state of slanting to left (see double dotted-line in Fig) at next moment, from the view of the drum body (2) side, that is to say, the tilting direction changes in the axis direction of the revolving shaft (3) all the time. According to this, the milling chamber (11) sways in the axis direction of the revolving shaft (3) with the very fast speed around the revolving shaft (3).

In this case, the loading members (5) in milling chamber (11) are jumped up strongly by the division member (4) and then are fallen. Since the milling chamber (11) sways quickly in the axis direction of the revolving shaft (3), the loading members (5) move with reciprocating motion quickly. Because of this, the direction of each movement of the loading members (5) and objects to be milled becomes complicated, and they become not to rotate together so that the number of collision between loading members (5) and the objects to be milled increases very much. Therefore, the milling efficiency of the object to be milled improves remarkably and a mass of objects to be milled can be milled to the desired size in a short time.

Next, workings of the mill (1) related to the present invention will be described.

First of all, objects to be milled are charged from hopper for the charging (9). Then, the objects to be milled enter into a milling chamber (11), which is the first one from the upper stream side (See FIGS. 1 and 2). Since the division members (4) are mounted on the revolving shaft (3) with tilting, the division members (4) repeat forward-tilting state and rear-tilting Ad state quickly in the axis direction the revolving shaft (3). Because of this, the objects to be milled are jumped up strongly and then are fallen, and move with reciprocating motion quickly in the axis direction of the revolving shaft (3) with being repeated raising and falling. Because of this, the objects to be milled are milled in the milling chamber (11) which is the first one.

After they are milled moderately within the milling chamber (11) which is the first one, the objects to be milled become the size whereof it is possible to pass through the introduction hole (12) provided on the division member (4) which is the first piece from the upper stream side. The objects to be milled, which have become such size, pass through introduction hole (12) and enter a milling chamber (11) which is the second one. In the milling chamber (11) which is the second one, plural loading members (5) are contained, and such loading members (5) are jumped up strongly by colliding to two sheets of the division members (4) tilted and then are fallen, and move with reciprocating motion quickly in the axis direction of the revolving shaft (3) with being repeated raising and falling. Because of this, collision between the objects to be milled and the loading members (5) are carried out thoroughly and strongly, in the milling chamber (11) which is the second one, milling is carried out efficiently and the grain diameter of the object to be milled becomes smaller.

After they are milled moderately within the milling chamber (11) which is the second one, the objects to be milled become the size whereof it is possible to pass through the introduction hole (12) provided on the division member (4) which is the second piece from the upper stream side. The objects to be milled, which have become such size, pass through introduction hole (12) and enter a milling chamber (11) which is the third one. Same process like the inside of the milling chamber (11) which is the second one is carried out in milling chambers (11) which are the third one, fourth one and so on, and the objects to be milled are milled till the size becomes desired size. The objects to be milled which become desired grain diameter are exhausted from a exhaust outlet (8) of the dram body (2). With the above, the milling process is completed.

Figure 7:
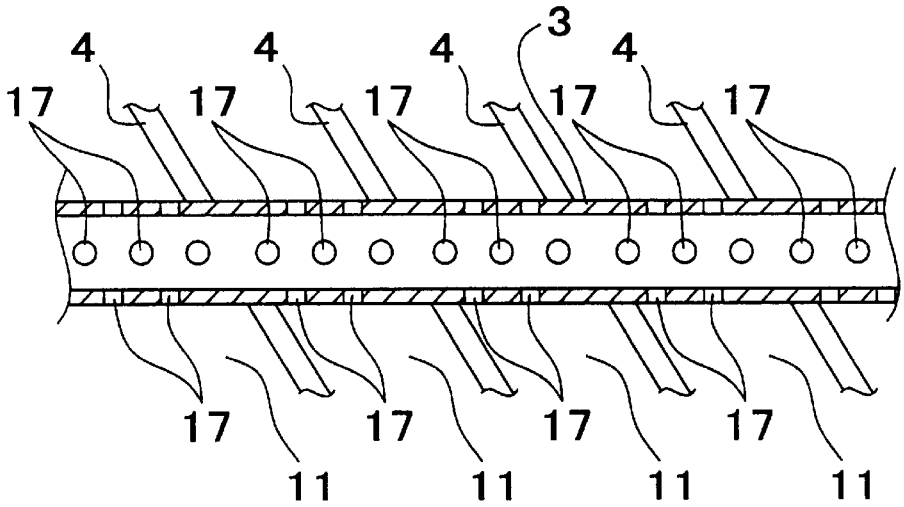
FIG. 7 is a section view showing an example of a revolving shaft related to the present invention.

Incidentally, as shown in FIG. 7, it is preferable to consist that the revolving shaft (3) is a hollow pipe shaft, aperture portions (17) opened inside of the milling chamber (11) are formed on the circumferential wall portion of the revolving shaft (3), and fluid for stirring (not shown in Fig) supplied from end portion of the revolving shaft (3) are spouted from the aperture portion (17). As the fluid for stirring, vapor, air, water and so on can be exemplified.

By spouting fluid for stirring from aperture portion (17), collision between the objects to be milled and the loading members (5) are carried out more strongly and thoroughly so that milling efficiency for the object to be milled can be improved more.

Moreover in the present invention, the size of loading members (5) may be the same; however, it is preferable that the sizes from the one contained in the milling chamber (11) of the upper stream side to the one contained in the milling chamber (11) of the lower reaches become small gradually as shown in FIG. 1. This is because that small loading member (5) is preferable to mill small object to be milled.

Furthermore, as shown in FIGS. 5 and 6, by forming difference in step extended radially on the division plate (4), the objects to be milled are jumped up certainly at such difference in step. In this case, the milling efficiency improves than the case using the division plate (4) in flat shape.

EXAMPLE

Hereinafter, by showing the example of the mill related to the present invention, the effect of this invention will be clear. However, the present invention is not limited to the following example at all.

Milling Test by the Example

1. The Composition of the Mill Related to the Present Invention

Dram body . . . A revolving drum having inside diameter: ø150 (mm), length: L500 (mm)

Division member mounted on a revolving shaft . . . Tilting disc having outside diameter: ø140 (mm)

Incidentally, an iron sphere having ø30 mm of outside diameter as a the loading member are used, and unoccupied rate inside of drum body is set to 40% when such iron spheres are loaded within the drum body.

2. Preparation for Object to be Milled

Aggregates having grain diameter of 0–40 mm obtained by crushing concrete rubbish with a crusher (impact crusher) are sieved with vibration and then ingredients having 0–10 mm are extracted so they are as objects to be milled.

3. Conditions of the Milling Process

Objects to be milled prepared are loaded into the dram body, and wet process whereof the dram body with 33 rpm; the revolving shaft with 150 rpm; are rotated oppositely each other is carried out. The result is shown in table 1.

TABLE 1

| Item | Quality Standards | Object to be Milled (Before Milling) | Object to be Milled (After Milling) |
|---|---|---|---|
| Density (Bone Dry) (g/cm$^3$) | 2.5 or more | 2.42 | 2.62 |
| Water absorption ratio (%) | 3.0 or less | 3.92 | 1.22 |
| Unit weight (kg/L) | 1.3~1.6 | 1.36 | 1.61 |
| Percentage of absolute volume (%) | 53 or more | 56.0 | 61.4 |

TABLE 1-continued

| Item | Quality Standards | Object to be Milled (Before Milling) | Object to be Milled (After Milling) |
|---|---|---|---|
| Test for amount of material passing standard sieve 74 $\mu$m (%) | 3.0 or less | 0.24 | 0.02 |
| Amount of clay lump in aggregate (%) | 1.0 or less | 0.52 | 0.27 |
| Stability test (%) | 10 or less | 18.9 | 9.7 |

As clear from table 1, in the milling process by the mill related to the present invention, every one of bone dry density (g/cm$^3$), water absorption ratio (%), unit weight (kg/L), percentage of absolute volume (%), test for amount of material passing standard sieve 74 $\mu$m (%), amount of clay lump in aggregate (%) and stability test (%) for the object to be milled after process shows very good value by consulting quality standards.

Major object in the present invention is to peel and remove mortar and/or cement coated on recycled concrete aggregates, and mortar and/or cement can be peeled and removed certainly in a short time by using this mill. Because of this, just recycled aggregates having good quality as same level as natural aggregate can be obtained.

The objects to be milled that milling is finished can be exhausted from exhaust outlet smoothly while the objects to be milled that are loaded into inside are milled and processed smoothly.

Therefore, processing speed being always constant could be maintained so amount of charging being always constant could be ensured. Furthermore, the processing speed was quite fast and the process could be finished in a short time.

Effect of the Invention

By using the mill related to the present invention, since the division members are mounted with tilting to the revolving shaft, the tilting direction of the division members always changes in the axis direction of the revolving shaft. According to this, the milling chamber sways around the revolving shaft in the axis direction of the revolving shaft with very fast speed. Because of this, the objects to be milled and loading members for milling are jumped up strongly so they can be raised and fallen quickly, and the objects to be milled and loading members for milling can be moved with reciprocating motion quickly in the axis direction of the revolving shaft. In this case, since the movement directions of the loading members for milling and the objects to be milled becomes complicated, respectively, it is possible to prevent that they rotate together so that the milling efficiency of the object to be milled improves remarkably.

What is claimed is:

1. A mill comprising:

a drum body providing an introduction inlet introducing objects to be milled on one end thereof and an exhaust outlet exhausting the objects to be milled after milling on the other end thereof;

a revolving shaft running through the inside of said drum body in the axis direction of said drum body;

division members mounted on said revolving shaft tilted vertically with respect to said revolving shaft, dividing the inside of said drum body, and forming plurality of milling chambers communicating through mutually in said drum body; and a plurality of loading members for milling charged in said milling chambers;

wherein said loading members for milling repeatedly rise and fall by rotation of said division members and move with reciprocating motion in the axis direction of said revolving shaft;

wherein said division members comprise a plurality of fan-shaped portions that are each arranged to tilt radially with respect to said revolving shaft forming the shape of propeller as a whole, and connection portions connecting differences in step between adjacent fan-shaped portions preventing the passage of said loading members for milling and agitating said loading members for milling.

2. The mill as set forth in claim 1, wherein said division members are provided plurally in the axis direction of said revolving shaft with intervals, and said milling chamber is formed between said division members.

3. The mill as set forth in claim 2, wherein each of said division members has introduction holes letting through objects to be milled and the diameter of said introduction holes is the size what the object to be milled, which has been milled to less than fixed size, and wherein such fixed size becomes gradually smaller from the division member on the upper stream side of the drum body to the division member on the lower reaches side.

4. The mill as set forth in claim 1, wherein each of said division members has introduction holes letting through objects to be milled and the diameter of said introduction holes is the size of what only the object to be milled, which has been milled to less than fixed size.

5. The mill as set forth in claim 1, wherein said revolving shaft is a hollow pipe shaft, having a plurality of aperture portions opened inside of the said milling chamber wherein said aperture portions are formed on the circumferential wall portion of said revolving shaft and fluid for stirring supplied from one end portion of said the revolving shaft is spouted from said aperture portions.

6. The mill as set forth in claim 1, wherein said drum body and said revolving shaft are rotated in the opposite directions mutually.

7. The mill as set forth in claim 1, wherein the outline of each said division member is formed elliptically and the whole periphery portion thereof approaches the internal circumference face of said drum body.

8. The mill as set forth in claim 1, wherein said connection portions and the fan-shaped portions are board shape, respectively, and they are formed integrally.

9. The mill as set forth in claim 1, wherein the size of said loading members for milling contained in the milling chambers becomes gradually smaller from the milling chamber located at the upper stream side to the milling chamber located at the lower reaches.

* * * * *